United States Patent [19]

Watson, Jr. et al.

[11] 4,331,704

[45] May 25, 1982

[54] ACRYLATED SILICONES AS RADIATION-CURABLE OVERPRINT VARNISHES

[75] Inventors: Stuart L. Watson, Jr., South Charleston; Richard G. Carter, Charleston, both of W. Va.

[73] Assignee: Union Carbide Corporation, Danbury, Conn.

[21] Appl. No.: 97,443

[22] Filed: Nov. 26, 1979

[51] Int. Cl.[3] ..... B05D 3/06

[52] U.S. Cl. ..... 427/54.1; 204/159.13

[58] Field of Search ..... 427/44, 54.1, 53.1; 204/159.13

[56] References Cited

U.S. PATENT DOCUMENTS

| | | | |
|---|---|---|---|
| 2,453,769 | 11/1948 | Wendt | 427/54.1 |
| 3,437,512 | 4/1969 | Burlant et al. | 427/44 |
| 3,437,513 | 4/1969 | Burlant et al. | 427/44 |
| 3,650,813 | 3/1972 | Nordstrom | 427/44 |
| 3,673,140 | 6/1972 | Ackerman et al. | 204/159.19 |
| 3,719,723 | 3/1973 | Nordstrom | 204/159.13 |
| 3,878,263 | 4/1975 | Martin | 268/825 |
| 3,960,073 | 6/1976 | Rush | 118/66 |
| 3,989,609 | 11/1976 | Brack | 427/54.1 |
| 4,116,786 | 9/1978 | Hodakowski | 204/159.13 |
| 4,130,708 | 12/1978 | Friedlander et al. | 204/159.13 |

FOREIGN PATENT DOCUMENTS

| | | |
|---|---|---|
| 2333514 | 1/1973 | Fed. Rep. of Germany . |

*Primary Examiner*—John H. Newsome
*Attorney, Agent, or Firm*—Henry H. Gibson

[57] ABSTRACT

Acrylated organomodified silicone compounds are formulated into radiation-curable varnishes applied in thin films to the surface of uncured, oil-based ink prints in line with the printing operation. The coating cures to a tack-free high gloss surface.

9 Claims, No Drawings

ACRYLATED SILICONES AS RADIATION-CURABLE OVERPRINT VARNISHES

BACKGROUND OF THE INVENTION

Much of the material printed with drying oil-based inks is used in applications which require that the surface over the printed image have a high gloss. The conventional approach to achieving such a finish is through lamination of a clear plastic or cellulosic film over the printed sheet after the inks have cured, or by the off-line application of a laquer or varnish, also after the inks have cured. The advent of commercially available, radiation-curable coatings has made it possible to apply a specially formulated, low-viscosity varnish to the surface of the print in-line with the printing press while the ink is in the uncured state. This varnish can be very efficiently cured right after application to yield a smooth, tack-free surface which protects the ink in the stack or roll of printed material while the ink cures gradually by oxidation. The use of a radiation-curable varnish in this way also allows the elimination of the anti-set-off spray powder often used in the sheet-feed, lithographic process; this powder is difficult to keep out of the pressroom environment and gives a rough, gritting feeling to the print surface.

There have been many attempts by those skilled in the art to formulate a radiation-curable varnish which can be applied in a thin film of a thickness 0.0003 inch or less, that will flow out to a smooth, ripple-free surface before curing and that will cure at practical line speeds of from 300 to 400 feet per minute or greater to a reasonably flexible, adherent film having a high gloss.

The main difficulty that has been encountered in trying to achieve this result has been the reduction in gloss level that occurs over heavy films of some inks as they cure under the already-cured varnish film. The inks appear to increase in surface roughness as they cure, causing the overlying varnish film, which is deformable in most practical cases, to also take on a surface roughness. This problem is exacerbated by the tendency of all-organic acrylates to diffuse into and mix with the wet ink film before they are cured. Furthermore, it is believed that certain lower molecular weight components of ink and the volatile, oxygenated products of drying oil oxidation can diffuse into the cured, all-organic acrylate varnish film resulting in uneven deformation, such as micro-wrinkling, of the varnish film. All of these proposed mechanisms work to produce an uneven and consequently lower-gloss varnish surface.

A radiation-curable coating which can be applied in thin films over oil-based ink prints and cures to a high gloss finish would be highly desirable.

SUMMARY OF THE INVENTION

It has now been found that certain acrylated organomodified silicone compounds, which are hereinafter more fully described, can be formulated into radiation-curable varnishes. These varnishes can then be applied in thin films to the surface of uncured, oil-based ink prints in line with the printing operation. These varnishes, upon exposure to radiation, cure to a tack-free high gloss surface.

DESCRIPTION OF THE INVENTION

This invention is the use of radiation-curable coatings formulated with acrylated silicones as varnishes over uncured oil-based ink prints.

The general class of compounds known as acrylated silicones are well known and many specific examples are described in B.D.Offen. No. 2,233,514, U.S. Pat. No. 3,650,813 and U.S. Pat. No. 3,878,263. In addition to the known acrylated silicones two novel classes of acrylated silicones, termed acrylated urethane silicones and acrylated epoxy silicones are also useful in the formulation of the radiation-curable varnishes in the process of this invention.

The acrylated urethane silicones are the reaction of a silicone having at least one reactive hydroxyl group in the molecule (a silicone carbinol), an organic polyisocyanate and a hydroxyalkyl acrylyl compound; all as hereinafter defined.

The silicone carbinols useful are those having a plurality of hydroxyl groups in the molecule, and many are commercially available. Among those suitable are those represented by the formula $R(OH)_n$ in which R represents a polysiloxane moeity and n is an integer having a value of from 2 to about 4. Basically two structures are known, the simply polydimethylsiloxy type and the grafted copoly type.

The polydimethylsiloxy type can be represented by the formula

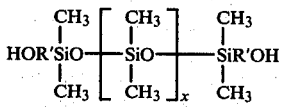

and the copoly type by the formula

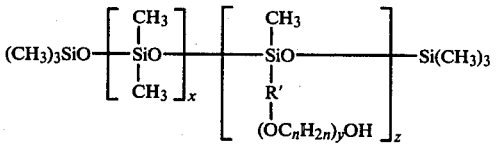

wherein

R' is an alkylene group having from 1 to 16 carbon atoms;

n is an integer having a value of 2 or 3;

x has a value of from 1 to 1000;

y has a value of from 0 to 15; and z has a value of from 1 to 6.

The organic polyisocyanates are known compounds and can be represented by the general formula $Q(NCO)_m$ wherein m has a value of from 2 to 5 and Q is the residual portion of the molecule to which the isocyanato groups are attached. Among those suitable for use in this invention one can mention 3,5,5-trimethyl-1-isocyanato-3-isocyanato-methyl-cyclohexane, di(2-isocyanatoethyl)-bicyclo[2.2.1]hept-5-ene-2,3-di-carboxylate, 2,4-tolylene diisocyanate, 2,6-tolylene diisocyanate, 4,4'-diphenylmethane diisocyanate, dianisidine diisocyanate, tolidine diisocyanate, hexamethylene diisocyanate, the m- and p-xylylene diisocyanates, tetramethylene diisocyanate, dicyclohexyl-4,4'-methane diisocyanate, cyclohexane-1,4-diisocyanate, 1,5-naphthylene diisocyanate, 4,4'-diisocyanate diphenyl ether, 2,4,6-triisocyanate toluene, 4,4',4''-triisocyanate triphenyl methane, diphenylene-4,4-diisocyanate, the polymethylene poly-phenylisocyanates, as well as any of the other organic isocyanates known to the average skilled chemist.

The hydroxyl acrylyl compounds suitable for use in producing the acrylated urethane silicones are those of the formula $$CH_2{=}\overset{\overset{\displaystyle X}{|}}{C}COOR''OH$$

wherein X is hydrogen or methyl and R'' is a linear or branched divalent alkylene having from 2 to about 5 carbon atoms. Illustrative thereof one can mention hydroxyethyl acrylate, hydroxypropyl acrylate, hydroxypentyl acrylate and the corresponding methyacrylates.

A simple representative formula for the acrylated urethane silicones produced using an organic diisocyanate and a silicone carbinol having two hydroxyl groups is the following:

$$(CH_2{=}\overset{\overset{\displaystyle X}{|}}{C}HCOOR''OOCNHQNHCOO)_2R$$

in which X,R, and R'' having the meanings previously indicated and Q is the polyvalent residue remaining after reaction of the polyisocyanates and can be linear or branched alkylene having from 1 to 10 carbon atoms; arylene, alkyarylene or aralkylene having from 6 to 12 carbon atoms; cycloalkylene having from 5 to 10 carbon atoms; or bicycloalkylene having from 7 to 15 carbon atoms. Those skilled in the art can readily write the formulas for the products prepared using polyisocyanates and carbinols of other functionalities.

The acrylated epoxy silicones can be represented by the general formula:

$$M{-}D_x{-}D_y'''{-}D_z''{-}M$$

wherein

M is an $R_3'''SiO_{0.5}$ group;

D is an $-\overset{\overset{\displaystyle R'''}{|}}{\underset{\underset{\displaystyle R'''}{|}}{Si}}O-$ group;

D'' is an $-\overset{\overset{\displaystyle R'''}{|}}{\underset{\underset{\displaystyle C_3H_6(OC_2H_4)_p(OC_3H_6)_qOR''''}{|}}{Si}}O-$ D''' is an $-\overset{\overset{\displaystyle R'''}{|}}{\underset{\underset{\displaystyle C_3H_6OCH_2\overset{\overset{\displaystyle OH}{|}}{C}HCH_2}{|}}{Si}}O-$ $\quad OOCCX{=}CH_2$ or an $-\overset{\overset{\displaystyle R'''}{|}}{\underset{\underset{\displaystyle CH_2CH_2}{|}}{Si}}O-$ 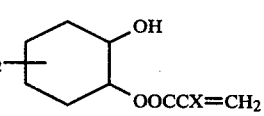

group;

X is hydrogen or methyl;

R''' is an alkyl group having from 1 to 5 carbon atoms, a cycloalkyl group having from 5 to 7 ring carbon atoms; an aryl group having 6 ring carbon atoms, or an alkoxy group having from 1 to 3 carbon atoms;

R'''' is an alkyl group having from 1 to 5 carbon atoms;

p is an integer having a value of from about 0 to 25;

q is an integer having a value of from 0 to about 25;

x is an integer having a value of from 0 to about 100;

y is an integer having a value of from 1 to about 5; and z is an integer having a value of from 0 to about 10.

The position of the hydroxyl and the acrylic moieties may be as represented or may be reversed. The silicone backbone of the main chain may be linear, branched or cyclic and may be continuous or discontinuous being a random arrangement of the D, D' and D''' groups as is known to those skilled in the art; in addition those skilled in the art are aware of the fact that the ethyleneoxy and propyleneoxy groups can be random or block in the molecule structure.

Another class of compounds useful in the formulation of radiation-curable coatings for use in the improved process of this invention are organopolysiloxane compounds of the general formula $$\left[R_a^{\nu}\,Si_{\frac{4-a}{2}}\right]_b$$

wherein b has an average value greater than about 25, and is preferably from about 100 to 500; each $R^{\nu}$, individually, is acryloxy, methyacryloxy, an unsubstituted monovalent hydrocarbon radical having from 1 to 20 carbon atoms or a substituted monovalent hydrocarbon radical wherein the substituents are selected from the class consisting of chloro, fluoro, cyano, amido, nitro, ureido, isocyanato, carboxy, hydroxy, acryloxy, methacryloxy and the like; and a has an average value of from about 1.8 to 2.2; said organopolysiloxane containing an average of at least one $R^{\nu}$ group which contain an acryloxy or methacryloxy group; each acryloxy or methacryloxy group being attached to the siloxane backbone through a carbon-to-silicon bond or a carbon-oxygen-silicon bond.

The acrylated silicones useful in the formulation of varnishes for use in the improved process of this invention can have an acrylate functionality of from 1 acrylate group per molecule to 100 acrylate groups per molecule. They can have a molecular weight of from about 425 to about 90,000 preferably from about 2000 to about 20,000. The viscosity at 25° C. of the acrylated silicones can vary from 10 cps to 4000 cps, preferably from 100 cps to 2000 cps. The acrylate equivalent weight of the acrylated silicones, defined as the ratio of molecular weight to acrylate functionality can be from about 200 to about 1500, preferably from about 250 to about 900.

The radiation-curable varnishes useful in the process of this invention can be formulated with just the acrylated silicone alone as the only polymerization component or they can be modified by combination with other ingredients. A wide variety of unsaturated monomers and oligomers well known to formulators of radiation-curable coatings may be used with the acrylated silicones in a concentration of up to 80 weight percent based on the total weight of the coating. The desirable range of the unsaturated monomer is from 5 weight percent to 50 weight percent and the desirable range of the oligomer is from 5 weight percent to 25 weight percent.

Illustrative of the many suitable unsaturated compounds one can mention methyl acrylate, ethyl acrylate, 2-ethylhexyl acrylate, methoxyethyl acrylate, butoxyethyl acrylate, butyl acrylate, methoxybutyl acrylate, cyano acrylate, cyanoethyl acrylate, phenyl acrylate, methyl methyacrylate, propyl methacrylate, methoxyethyl methacrylate, ethoxymethyl methacrylate, phenyl methacrylate, ethyl methacrylate, lauryl methacrylate, N,N-dimethyl acrylamide, N,N-diisopropyl acrylamide, N,N-didecyl acrylamide, N,N-dimethyl methacrylamide, N,N-diethyl methacrylamide, (N,N-dimethylamino)methyl acrylate, 2-(N,N-dimethylamino)ethyl acrylate, 2-(N,N-dipentylamino)ethyl acrylate, N,N-dimethylamino)methyl methacrylate, 2-(N,N-diethylamino)propyl acrylate, ethylene glycol diacrylate, propylene glycol diacrylate, neopentyl glycol diacrylate, 1,6-hexanediol diacrylate, diethylene glycol diacrylate, triethylene glycol diacrylate, dipropylene glycol diacrylate, ethylene glycol diacrylate, ethylene glycol dimethyacrylate, propylene glycol dimethacrylate, diethylene glycol dimethyacrylate, tripropylene glycol diacrylate, trimethylolpropane triacrylate, pentaerythritol triacrylate, isodecyl acrylate, phenoxyethyl acrylate, and the like.

The radiation-curable varnishes can contain up to 10 weight percent of a photoinitiator or combinations thereof when they are to be cured by light radiation. These photoinitiators are well known to those skilled in the art and illustrative thereof one can name $\alpha$, $\alpha$-di-$\beta$-butoxyacetophenone, 2,2-diethoxyacetophenone, benzophenone, p-methoxybenzophenone, acetophenone, propiophenone, benzoin, benzil, benzaldehyde, napthoquinone, anthraquinone and the like. The preferred photoinitiator for curing with ultraviolet radiation under an inert atmosphere is $\alpha$, $\alpha$-di-$\beta$-butoxyacetophenone at a concentration of from 1 weight percent to 3 weight percent based on the weight of the acrylated silicone present.

The radiation-curable varnishes can also have present other additives at a concentration of up to 25 weight percent based on the weight of the acrylated silicone. These additives are well known to formulators of radiation-curable coatings and include waxes, other silicones, inert fillers, modifying resins such as flow-control and surface tension modifiers, plasticizers and the like.

The radiation-curable varnishes can be applied by conventional means including spray, curtain, dip, pad, rollcoating and brushing procedures. They can be cured by exposure to heat or radiation. When cured by heat, any of the known free radical activators can be present at the conventional concentrations. The radiation can be ionizing, either particulate or non-particulate, or non-ionizing radiation. A particularly usefuly type of radiation is ultraviolet radiation at a flux density of from about 100 watts to about 1000 watts per square foot of source projected area.

In a typical embodiment a radiation-curable varnish is formulated using an acrylated silicone copolymer fluid and $\alpha$, $\alpha$-di-$\beta$-butoxyacetophenone as photoinitiator. A sheet of paper is coated with ink and then immediately coated over the ink film with the varnish. The varnish film thus formed is immediately cured by exposure to ultraviolet light. The varnish exhibits good flow-out and wetting characteristics and cures to a high gloss finish.

The novel use of acrylated silicone based radiation-curable coatings as overprint varnishes has many advantages over the heretofore available methods of covering ink print with a protective film. Now, by the process of this invention uncured oil-based ink can be covered by a thin film of a radiation-curable acrylated silicone based varnish which exhibits a desirably low viscosity to molecular weight ratio, good flow-out over ink and paper alike, good wetting of the ink surface and minimal miscibility with the wet ink. The varnish can be applied immediately after the ink has been applied to the paper or other substrate making the process of this invention compatible for use in line with contemporary printing processes. The varnish can be cured immediately by exposure to radiation to yield a smooth, tack-free surface with a high gloss and improved scratch resistance and adhesion.

The effects resulting from the use of radiation-curable coatings formulated with acrylated silicones as overprint varnishes are very useful, unexpected and unobvious. They could not have been predicted.

The following examples serve to further illustrate the invention.

EXAMPLE 1

Three acrylated silicone copolymer fluids having the formula $MD_rD_s'M$ where

M is $Me_3SiO_{0.5}$,

D is $Me_2SiO$

D' is

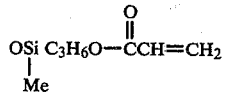

and Me is methyl and having the properties shown in Table I were mixed with $\alpha$, $\alpha$-di-$\beta$-butoxyacetophenone as photoinitiator in the ratio of 98 parts by weight of silicone to 2 parts by weight of photoinitiator to form a varnish which would be reactive to ultraviolet light.

TABLE I

| | Silicone | | |
|---|---|---|---|
| | 1 | 2 | 3 |
| Degree of Polymerization | 100 | 100 | 30 |
| Acrylated Units | 10 | 6 | 3 |
| Calculated Molecular Weight | 8558 | 8166 | 2914 |
| Viscosity (cps at 25° C.) | 210 | 220 | 60 |
| Gloss (60°) | 68% | 65% | 52% |

A sheet of coated offset paper was prepared by first casting an ink film using a hand proofer with a large charge of black ink on its surface so as to obtain two complete roller revolutions down the center of the sheet from top to bottom, then immediately applying the varnish over the ink film with a hand proofer equipped with a 180 line per inch quadragravure engraved metering roll. The varnish film thus formed was then immediately cured under nitrogen through an ultraviolet curing unit by exposure to an ultraviolet flux density of about 160 watts per square foot for a period of time of about 0.6 seconds. Cure of the varnishes was judged to be complete by virtue of their resistance to smudging and tack-free surface. Properties of the cured varnish films over the ink were evaluated about 20 hours after curing. All exhibited good gloss, flow-out and wetting over the ink. Gloss levels measured by a 60° C. glossmeter are shown in Table I.

For comparative purposes, a varnish was prepared using the procedure, photoinitiator and proportions, described above but substituting tetraethylene glycol diacrylate—an organic acrylate commonly used to formulate low-viscosity varnishes—for the acrylated silicone. The ink and varnish were applied to the paper, cured and tested following the procedure described above. The cured varnish film had a gloss reading of only 22 percent and showed only fair-to-poor flow-out and poor wetting over the ink.

This example establishes the great advantages of radiation-curable overprint varnishes formulated with acrylated silicones over those formulated with the conventionally used compounds.

EXAMPLE 2

The three acrylated silicone fluids described in Example 1 were mixed with organic acrylates and dibutoxyacetophone as photoinitiator to form six varnishes. The formulations are shown in Table II.

TABLE II

| | Varnish (Parts by Weight) | | | | | |
|---|---|---|---|---|---|---|
| | A | B | C | D | E | F |
| Silicone 1 | 88 | 76 | — | — | — | — |
| Silicone 2 | — | — | 91 | 83 | — | — |
| Silicone 3 | — | — | — | — | 89 | 78 |
| Trimethyl Propane Triacrylate | 10 | — | 7 | — | 9 | — |
| The diacrylic acid ester of the 4-mole ethylene oxide adduct of 2,2-dimethyl-3 2,2-dimethyl-3-hydroxypropyl-2,2-dimethyl-3-hydroxy-propionate | — | 22 | — | 15 | — | 20 |
| Dibutoxyacetophenone | 2 | 2 | 2 | 2 | 2 | 2 |

The varnishes were applied over wet ink films, cured and evaluated using the procedure described in Example 1. The results are shown in Table III.

TABLE III

| | Varnish | | | | | |
|---|---|---|---|---|---|---|
| | A | B | C | D | E | F |
| 60° Gloss | 68 | 67 | 76 | 78 | 58 | 61 |
| Flow-out Rating | Fair | Fair | Fair | Fair | Fair | Fair |
| Wetting Rating | Good | Good | Good | Good | Fair | Fair |

For comparative purposes, two varnishes formulated with the organic acrylates were applied, cured and evaluated using the same procedures as above. The formulations and test results are shown in Table IV.

TABLE IV

| | Varnish | |
|---|---|---|
| | A | B |
| | (Parts by Weight) | |
| Trimethylol Propane Triacrylate | 98 | — |
| The diacrylic acid ester of the 4-mole ethylene oxide adduct of 2,2-dimethyl-3-hydroxypropyl-2,2-dimethyl-3-hydroxy-propionate | — | 98 |
| Dibutoxyacetophenone | 2 | 2 |
| | (Test Results) | |
| 60° Gloss | 20 | 20 |
| Flow-out Rating | Good | Poor |

TABLE IV-continued

| | Varnish | |
|---|---|---|
| | A | B |
| Wetting Rating | Poor | Poor |

EXAMPLE 3

An acrylated urethane silicone was prepared as follows. To a 500 ml four-neck round-bottom flask equipped with a mechanical stirrer cooling water bath and dropping funnel there were charged 35.5 grams of isophorone diisocyanate and 5 drops of dibutyl tin dilaurate as catalyst. While the temperature was maintained at about ambient with the cooling water bath, 20.0 grams of 2-hydroxyethyl acrylate was added dropwise with stirring. When the addition was complete the mixture was stirred at room temperature for about 4 hours. Thereafter 50 grams of a silicone polycarbinol having a hydroxyl number of 200 mg. KOH/g, a specific gravity of 1.06 at 25° C. and a viscosity of 350 centistokes at 25° C. was added dropwise. The mixture was stirred at ambient temperature for about 16 hours.

The radiation-curable varnish was prepared by combining 73 parts of the acrylated urethane silicone prepared above with 25 parts of trimethylolpropane triacrylate and 2 parts of $\alpha,\alpha$-di-$\beta$-butoxyacetophenone as photoinitiator. A sheet of coated offset paper was prepared by coating an ink film using a hand proofer with a large charge of black ink so as to obtain two complete roller revolutions down the center of the sheet from top to bottom then immediately applying the varnish over the ink film with another hand film proofer equipped with a 180 line per inch quardragravure engraved metering roll. The varnish film thus formed was then immediately cured under a nitrogen atmosphere by exposure to an ultraviolet flux density of 160 watts per square foot for a period of time of about 0.44 seconds. Cure of the varnish was judged to be complete by virtue of its resistance to fingernail scratch. After 20 hours the varnish was evaluated. The results were as follows:

| | |
|---|---|
| 60° gloss | 82% |
| Flow-out | Fair to Good |
| Wetting | Good |

This example establishes that radiation-curable varnishes formulated with acrylated urethane silicones are effective overprint-varnishes for in line printing operations.

EXAMPLE 4

An acrylated epoxy silicone was prepared as follows. To a 250 ml round-bottom three-neck flask equipped with a thermometer, heating mantle, dropping funnel, magnetic stirrer and dry air blanket there were charged 100 grams of an epoxy silicone of the formula MD''''M where M is $Me_3SiO_{0.5}$, D'''' is

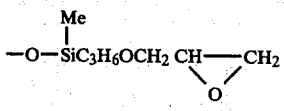

and Me is methyl and 1 gram of 1,4-diazabicyclo[2.2.2]octane as catalyst. The solution was heated to 90° C. with stirring and 21.4 grams of acrylic acid was added dropwise. The reaction mixture was then stirred at 90° C. for about 30 hours.

Four radiation-curable varnishes were prepared by mixing the acrylated epoxy silicone prepared above with the compounds in the proportions shown in Table V.

TABLE V

| | Varnish (Parts by Weight) | | | |
|---|---|---|---|---|
| | A | B | C | D |
| Acrylated Epoxy Silicone | 97 | 72 | 72 | 72 |
| Trimethylolpropane Tri-acrylate | — | 25 | 20 | 20 |
| Isodecyl Acrylate | — | — | 5 | — |
| Phenoxyethyl Acrylate | — | — | — | 5 |
| Diethoxyacetophenone | 2 | 2 | 2 | 2 |
| Silicone flow control agent | 1 | 1 | 1 | 1 |

The varnish formulations described in Table V were used to overprint a film of uncured, oil-base ink on clay-coated offset paper. The films were cast with a hand proofer using a large charge of black ink. The varnish film was immediately applied over the wet film using a hand proofer equipped with a 180 line per inch quadragravure engraved metering cylinder. The varnish film was then cured immediately by exposure to a flux density of about 160 watts per square foot for a period of time of about 0.87 seconds. After 20 hours the varnishes were evaluated. The results are shown in Table VI.

TABLE VI

| | Varnish | | | |
|---|---|---|---|---|
| | A | B | C | D |
| 60° Gloss | 68 | 64 | 67 | 68 |
| Flow-out | Good | Good | Good | Good |
| Scratch Resistance (Fingernail) | Fair | Good | Good | Good |
| Adhesion - "Scotch Tape" Percent Remaining | 100 | 100 | 100 | 100 |

This example establishes that radiation-curable varnishes formulated with acrylated epoxy silicone are effective overprint varnishes for in line printing operations.

What is claimed is:

1. In a method of printing comprising:
(a) administering uncured, relatively radiation uncurable, oil-based ink to a surface;
(b) immediately covering the uncured inked surface with a radiation-curable coating;
(c) radiation curing the radiation-curable coating; and
(d) subsequently allowing the ink to cure; the improvement comprising covering the inked surface with a radiation-curable coating formulated with an acrylated silicone.

2. The improvement as claimed in claim 1 wherein the acrylated silicone is an acrylated urethane silicone.

3. The improvement as claimed in claim 1 wherein the acrylated silicone is an acrylated epoxy silicone having the general formula:

$$M-D_x-D_y'''-D_z''-M$$

wherein

M is an $R_3'''SiO_{0.5}$ group;

D is an 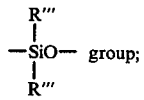 group;

D'' is an 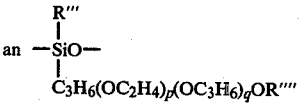 group;

D''' is an 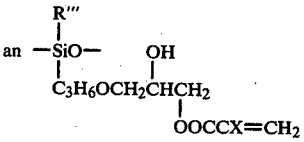

or an 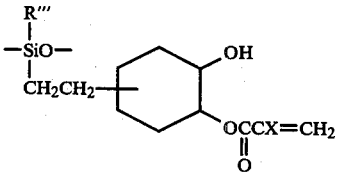 group;

X is a hydrogen or methyl;

R''' is an alkyl group having from 1 to 5 carbon atoms, a cycloalkyl group having from 5 to 7 carbon atoms, an aryl group having 6 ring carbon atoms, or an alkoxy group having from 1 to 3 carbon atoms;

R'''' is an alkyl group having from 1 to 5 carbon atoms;

p is an integer having a value of from about 0 to 25;

q is an integer having a value of from about 0 to 25;

x is an integer having a value of from 0 to about 100;

y is an integer having a value of from 1 to about 5; and z is an integer having a value of from 0 to about 10;

and wherein the silicone backbone may be linear, branched or cyclic and may be continuous or discontinuous being a random arrangement of D, D'' and D''' groups.

4. The improvement as claimed in claim 1 wherein the radiation-curable coating has present a photoinitiator in a concentration of up to 10 weight percent based on the weight of the acrylated silicone present.

5. The improvement as claimed in claim 1 wherein the acrylated silicone has a acrylated functionality of from 1 to 100.

6. The improvement as claimed in claim 1 wherein the acrylated silicone has a molecular weight of from about 425 to about 90,000.

7. The improvement as claimed in claim 1 wherein the acrylated silicone has a viscosity at 25° C. of from 10 cps to 400 cps.

8. The improvement as claimed in claim 1 wherein the acrylated silicone has a acrylate equivalent weight of from about 200 to about 1500.

9. The improvement as claimed in claim 1 wherein the acrylated silicone has the formula $MD_rD_s'M$ where
M is $Me_3SiO_{0.5}$;
D is $Me_2SiO$
D' is
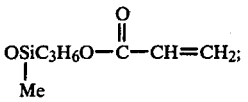
r is an integer having a value of from 25 to about 500; and
s is an integer having a value of from 1 to 100.
* * * * *